United States Patent [19]

Parry

[11] 4,409,446

[45] Oct. 11, 1983

[54] ELECTRICAL SWITCHGEAR

[75] Inventor: John Parry, Gwent, Wales

[73] Assignee: South Wales Switchgear Limited, Wales

[21] Appl. No.: 343,200

[22] Filed: Jan. 27, 1982

[51] Int. Cl.[3] ..... H01H 33/18

[52] U.S. Cl. ..... 200/147 R; 200/148 R

[58] Field of Search ..... 200/147 R, 147 A, 148 B, 200/148 R

[56] References Cited

U.S. PATENT DOCUMENTS 4,301,340 11/1981 Parry ..... 200/147 R 4,301,341 11/1981 Parry ..... 200/147 R

*Primary Examiner*—Robert S. Macon

*Attorney, Agent, or Firm*—Charles E. Brown

[57] ABSTRACT

A first contact has an end portion which engages a second contact in a contacts closed position of the switchgear and which moves transversely across a pole face of a field coil and inwardly of an axis of the latter during movement of the contacts to an open position. The field coil is electrically connected in series with an arcing electrode and to which the second contact is also connected. Upon movement of the contacts from their closed position to their open position, an arc is drawn between the end portion of the first contact and a portion of the second contact. Further movement of the contacts towards their open position causes the arc to transfer its root from the second contact portion to the arcing electrode so that an arcing current then flows through the field coil to generate a magnetic field which causes the arc to rotate and become extinguished. Extinction of the arc is assisted by an electrically insulating fluid surrounding the switchgear. A principal arcing zone is defined by rotation of the arc, and the arc is disposed in this zone when it transfers its root from the second contact to the arcing electrode so that it can rotate immediately under the influence of the magnetic field.

15 Claims, 10 Drawing Figures

ELECTRICAL SWITCHGEAR

This invention relates to electical switchgear emloying an electrically insulating fluid for arc extinction.

British Patent Specification No. 2044538 describes electrical switchgear of this type comprising generally first and second contacts which are movable between open and closed positions, and a field coil electrically connected in series with an arcing electrode. Movement of the first and second contacts from their closed position towards their open position causes an arc to be drawn therebetween, and further movement of the contacts towards their open position causes the arc to transfer its root from the second contact to the arcing electrode, whereby the arcing current flowing through the field coil causes the arc to rotate and become extinguished, such rotation of the arc defining a principal arcing zone. The first contact has an end portion which engages the second contact when the contacts are in their closed position and which, during movement of the contacts to their open position, moves transversely across a pole face of the field coil and inwardly of its axis.

Transfer of the arc from the second contact to the arcing electrode occurs in three stages as follows. A primary arc is drawn between the first and second contacts upon their mutual disengagement. Upon continued movement of the contacts towards their open position, the end portion of the first contact passes within a very short distance (such as 1 mm) of the arcing electrode. As the separation between the first and second contacts increases, the arc voltage increases until it is sufficient to break down the small gap between the end portion of the first contact and the arcing electrode. The arc then transfers its root from the second contact to the arcing electrode, such transfer being assisted by magnetic loop effects and movement of the products of the primary arc (which help to ionise the gap).

The small gap between the end portion of the first contact and the arcing electrode remains substantially constant until the first contact moves beyond the edge of the arcing electrode, whereupon extension of the arc radially inwardly of the field coil axis commences. The arc then comes under the influence of the magnetic field produced by the arcing current flowing through the field coil, and is thereby rotated in the above-mentioned principal arcing zone, finally becoming extinguished. Up to the point where radially inward extension of the arc commences, the arc is relatively immobile although the root of the arc will try to move along the edge of the electrode under the influence of a component of the magnetic field external to the principal arcing zone. Both the primary arc and the initial transfer arc are outside the principal arcing zone and produce arc energy which can impose a limit to the interrupting capacity of the switchgear, partly by exposing major components and insulators to the direct effects of these arcs.

It is an object of the present invention to obviate or mitigate this problem, whereby electrical switchgear of improved interrupting capacity can be achieved.

This object is achieved according to the invention by arranging for the arc to be within the principal arcing zone when it transfers its root from the second contact to the arcing electrode, so that the arc can rotate immediately under the influence of said magnetic field. The resultant rapid transfer and subsequent movement of the arc root on the surface of the arcing electrode greatly reduces or eliminates the need to protect the electrode from erosion due to arcing effects by means of highly arc-resistant material, which is expensive.

Desirably, the second contact includes a portion which is engageable by the end portion of the first contact and which, at least when said contacts disengage, is disposed substantially the same distance from the field coil axis as an adjacent part of the arcing electrode. In one particular arrangement, said portion of the second contact is movable between positions in which it is respectively extended and retracted with respect to the remainder of the second contact, and the contacts disengage when said portion is in its extended position. Said portion of the second contact can be accommodated within a cut-out in the arcing electrode.

In certain low load current applications, the second contact may be electrically connected to the arcing electrode, so that the field coil is permanently connected in series. The magnetic field produced by the field coil will therefore be present when the primary arc is initially drawn, ensuring that the arc commences its rotation immediately upon contact separation.

Preferably, the first contact is pivotable about an axis which is transverse to the field coil axis and which is conveniently also offset therefrom. In the latter case, the first contact can be cranked so that its end portion lies along the field coil axis when the contacts are fully open.

The electrically insulating fluid employed for arc extinction is advantageously sulphur hexafluoride, although other suitably insulating gases can be used.

The present invention will now be further described, by way of example, with reference to the accompanying drawings, in which.

Figure 1:
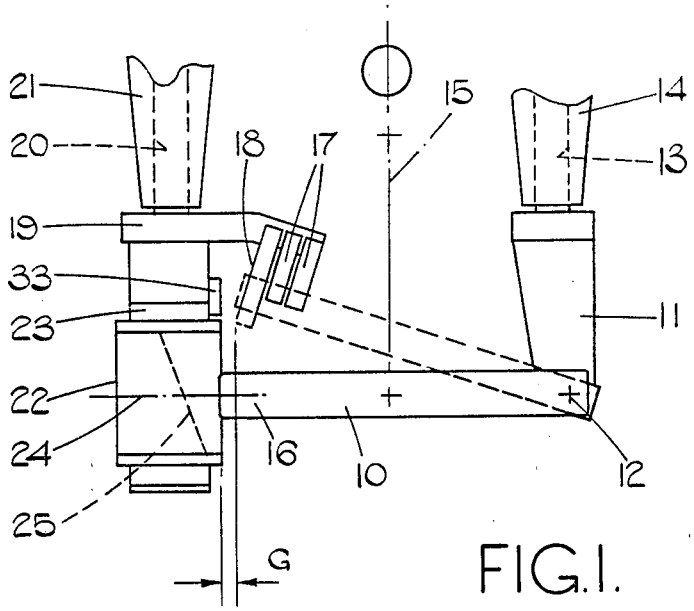
FIGS. 1 to 6 are respectively schematic side views of six different embodiments of electrical switchgear according to the present invention.

Referring first to FIG. 1, the electrical switchgear shown therein comprises a contact arm 10 which is electrically connected to a support 11 and which is mounted thereon for pivotal movement about an axis 12. The support 11 is in turn electrically connected to a conductor 13 which passes through an insulating bushing 14. An operating mechanism 15 (indicated schematically by chain-dotted lines) is provided for pivoting the contact arm 10 about the axis 12 between a closed position (indicated by broken lines) in which an end portion 16 thereof engages a number of fixed contact fingers 17 and an open position (shown by full lines) in which the end portion 16 is spaced from the contact fingers 17. The contact arm 10 is in fact of generally rectangular cross-section (although this is not essential) and the contact fingers 17 are provided in two spaced-apart sets which, when the contact arm 10 is in its closed position, engage opposite sides of the end portion 16. One contact finger or pair of fingers 18 is extended in length for a purpose which will be explained later.

The contact fingers 17, 18 are carried by a conductive clamping block 19 which is in turn connected to a conductor 20 which passes through an insulating bushing 21. Supported from the conductor 20 are a tubular arcing electrode 22 of circular cross-section and a field coil 23, the field coil 23 being wound around the external surface of the arcing electrode 22 and being electrically connected between the latter and the conductor 20. The whole assembly is enclosed within a housing (not shown) which contains the highly insulating gas sulphur hexafluoride, the bushings 14 and 21 with their respective conductors 13 and 20 extending to the exterior of the housing.

Thus far described, the switchgear is similar to that shown in FIG. 1 of the above-mentioned British Patent Specification No. 2044538 and operates in a generally similar manner. That is, upon initial movement of the contact arm 10 from its closed position towards its open position, a primary arc is drawn between the extended contact finger or fingers and the end portion 16 of the contact arm. The end portion 16 then passes within a small distance from the arcing electrode 22, whereupon the arc transfers its root from the contact finger or fingers 18 to the arcing electrode. This brings the field coil 23 into circuit, and the arcing current which now passes through the field coil produces a magnetic field. Further movement of the contact arm 10 towards its open position causes the end portion 16 thereof to move transversely across a pole face of the field coil and radially inwardly of the axis of the latter (indicated at 24), since the pivot axis 12 of the contact arm 10 is perpendicular to the field coil axis. The magnetic field produced by the field coil 23 causes the arc between the arcing electrode 22 and the contact arm 10 to rotate and become extinguished, quenching of the arc being assisted by the sulphur hexafluoride gas. Rotation of the arc occurs within a principal arcing zone, a typical track of the arc root on the internal surface of the arcing electrode being bounded approximately as indicated by a dotted line 25.

The above-described arrangement differs, however, from the construction shown in FIG. 1 of Bristish Patent Specification No. 2044538 in the following important respect. The extended contact finger or fingers 18 terminates close to the internal surface of the arcing electrode 22. The primary arc is therefore not drawn until the end portion 16 of the contact arm 10 is very close to the arcing electrode 22, and moves rapidly towards the arcing electrode as it extends. When the arc transfers its root from the contact finger or fingers 18 to the arcing electrode, it is already disposed within the above-mentioned principal arcing zone, and therefore rotation of the arc can commence immediately. This is to be contrasted with the construction shown in FIG. 1 of the above-mentioned Patent Specification, wherein the arc remains substantially immobile for a time after it transfers its root to the arcing electrode, and will cause erosion of the arcing electrode unless the latter is provided with arc-resistant material, which is expensive. In the switchgear of the present application, it is not necessary to provide such arc-resistant material due to the rapid transfer and subsequent movement of the arc root on the arcing electrode.

Figure 2:
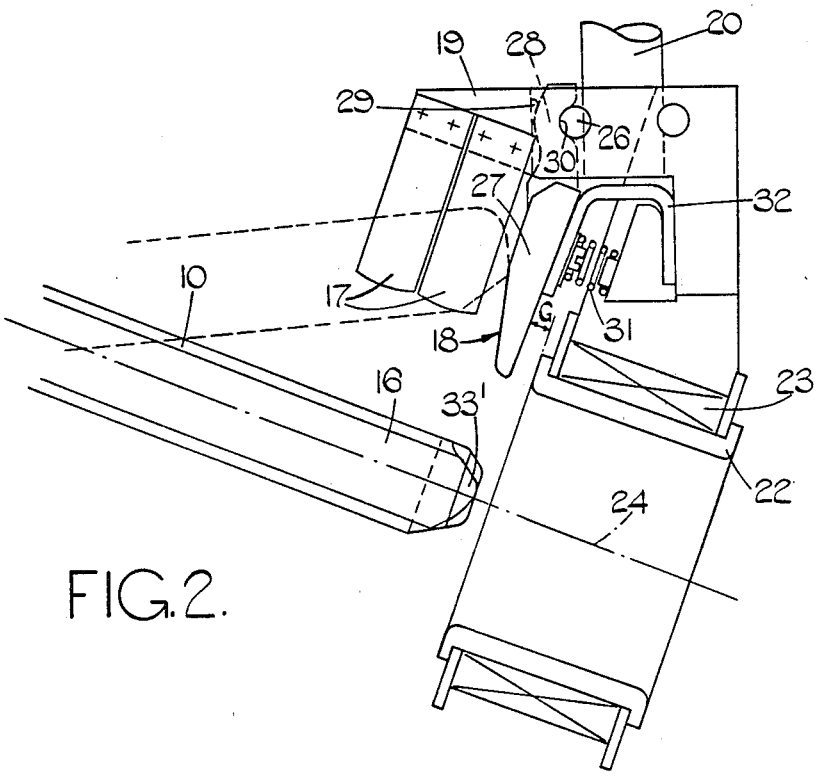

FIG. 2 shows an alternative arrangement for the extended contact finger or fingers 18. Whereas in the embodiment of FIG. 1 the finger or fingers is or are fixed, in FIG. 2 a single finger 18 is pivotable about a clamping bolt 26 of the clamping block 19. More particularly, the contact finger 18 is composed of a contact portion 27 which is engaged by the end portion 16 as the contact arm 10 moves into and out of its closed position, and a flat blade portion 28 which locates in a slot 29 in the clamping block 19 and which has a generally semicircular cut-out 30 which receives the clamping bolt 26. A compression spring 31 biasses the contact finger 18 into the position shown, and a flexible conductive strap 32 connects the contact portion 27 to the clamping block 19 to ensure proper passage of the arcing current. The contact porton 27 need not engage the end portion 16 when the contact arm 10 is in its fully closed position since adequate overlap with the main contact fingers 17 exists. If contact is retained in the fully closed position, however, this will supplement the carrying of the normal load current.

The contact portion 27 is made sufficiently wide to protect the field coil 23, thereby obviating the need to provide a special protective shield, for example as shown at 33 in FIG. 1. The gap G between the contact portion 27 and the arcing electrode 22 is large enough to permit the contact finger 18 to deflect as the contact arm 10 engages therewith and disengages therefrom, and to prevent shorting out of the field coil during current interruption. As in the previous embodiment, the contact finger 18 terminates close to the internal surface of the arcing electrode to ensure rapid transfer of the arc root and immediate rotation of the arc after such transfer.

The co-operating parts of the contact finger 18 and the contact arm 10 can be fully or partially tipped with arc-resistant material. In the particular construction shown, the end portion 16 of the contact arm 10 has a T-shaped insert 33 of special arc-resistant material which is configured to offer the maximum area and mass to the contact finger 18 while permitting efficient contact with the main contact fingers 17 at the sides. This arrangement avoids the need to provide arc-resistant material at the main contact points. The main contact fingers 17 can be increased in size independently of the finger 18 to carry a greater mormal load current. The contruction shown in FIG. 2 is particularly suitable for use in a three-phase circuit breaker, for example of the type shown in FIG. 3 of British Patent Specification No. 2044538.

Figure 3:
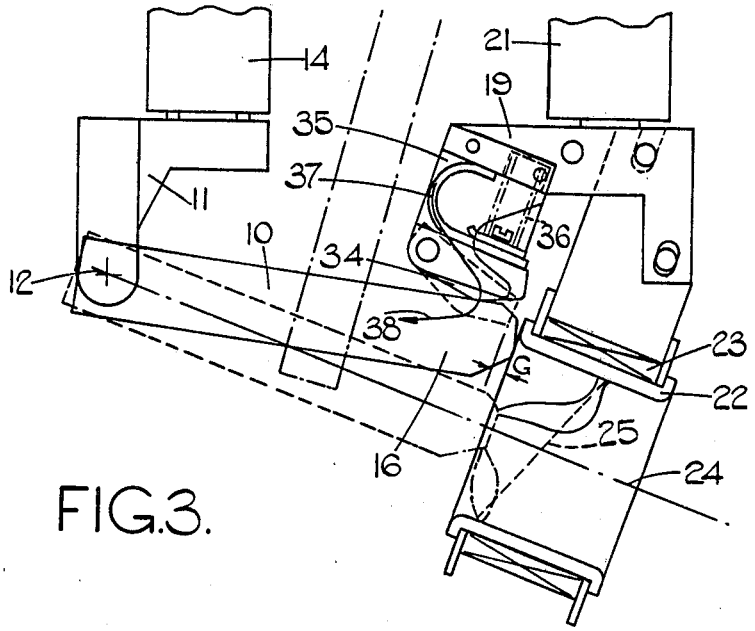

FIG. 3 shows a modified arrangement which, while still achieving a high interrupting capacity, is intended to carry a comparatively small normal current. Such an arrangement is particularly suited for use in the protection and control of a circuit supplying a power transformer, for example. Instead of a plurality of contact fingers, the fixed contact now comprises a contact block or blocks 34 which is or are pivotally mounted on a support 35 secured to the clamping block 19 for movement between an extended position (shown in full line) and a retracted position (shown in broken line) with respect thereto. A spring 36 urges the or each contact block 34 into its extended position, and a flexible conductive strap 37 electrically connects the block 34 to the clamping block 19. The or each contact block 34 makes a simple butt contact with the end portion 16 of the contact arm 10 when the latter is in its closed position.

Upon movement of the contact arm 10 towards its open position, initially the or each contact block 34 follows the movement of the end portion 16 and moves under the action of the spring 36 from its retracted to its extended position. Disengagement of the contacts occurs only after the or each contact block 34 has moved to a position wherein it is directly adjacent the arcing electrode 22, although as with the previous embodiments a gap G is still provided therebetween. This arangement ensures that there is a tight loop of current flow (as indicated by arrow 38) which assists acceleration of the arc towards the arcing electrode 22 after contact separation. As in the embodiments of FIGS. 1 and 2, when transfer of the arc root occurs the arc is already in the principal arcing zone, so that it immediately starts to rotate under the influence of the magnetic field produced by the field coil 23.

Figure 4:
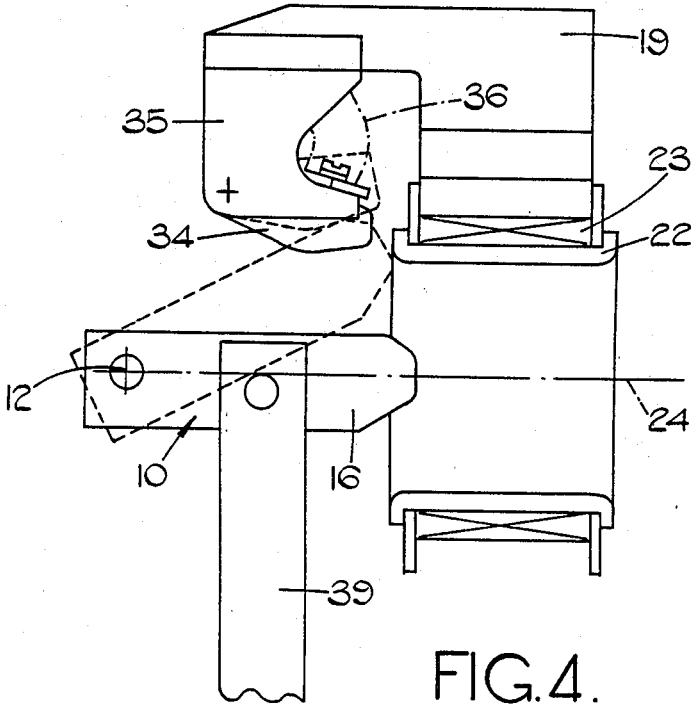

FIG. 4 shows a similar construction to FIG. 3, but which can be made rather more compact. In this construction, the pivot axis 12 of the contact arm 10 is positioned closer to the arcing electrode 22 and field coil 23 than in FIG. 3, with the result that greater penetration of the end portion 16 of the contact arm 10 into the arcing electrode 22 is achieved when the contact arm is in its fully open position. Reference numeral 39 designates an insulating operating link which is pivotally connected to the contact arm 10. This link is positioned generally in line with the fixed contact including the contact block 34, in contrast to the arrangement shown in FIG. 3 wherein a similar operating link is indicated by chain-dotted lines. This particular construction is especially suited for incorporation into a single switch, contactor, or ring main equipment similar to that shown in FIG. 6 of British Patent Specification No. 2044538 and FIGS. 1 to 3 of British Patent Specification No. 2038100.

Figure 5:
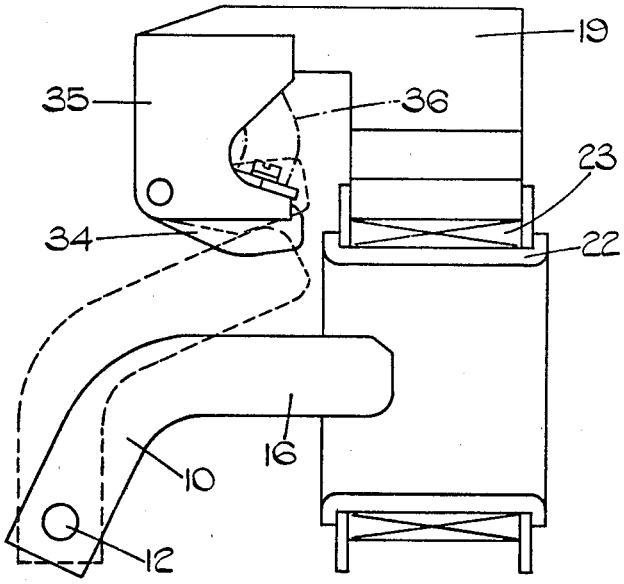

FIG. 5 shows a modification of the constructions illustrated in FIGS. 3 and 4. In FIGS. 3 and 4, the contact arm 10 is straight and its pivot axis 12 passes through the axis of the field coil 23. In FIG. 5, however, the contact arm is cranked and its pivot axis is offset from the field coil axis. Nevertheless, the end portion 16 still lies along the field coil axis when the contact arm is in its fully open position. This arrangement results in a good wiping action of the contact arm 10 on the contact block 34 as the latter engage and disengage, and achieves good penetration of the end portion 16 into the arcing electrode 22.

Figure 6:
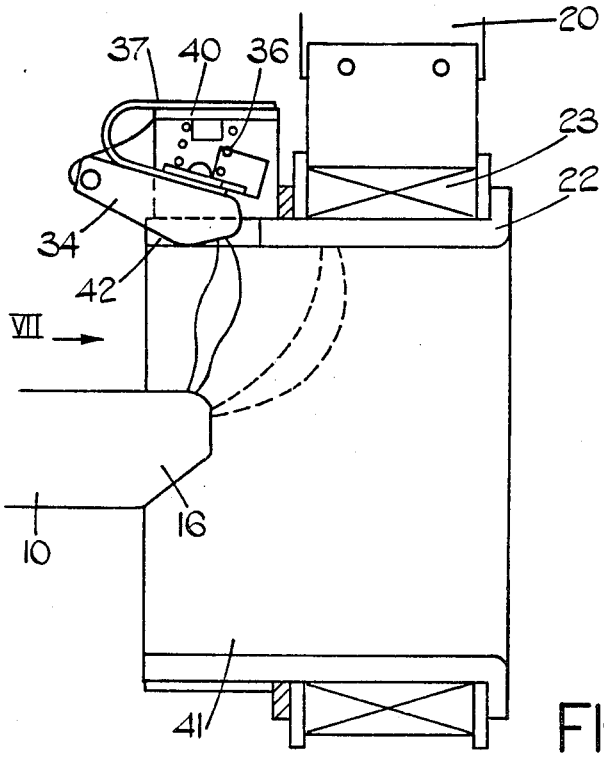
Figure 7:
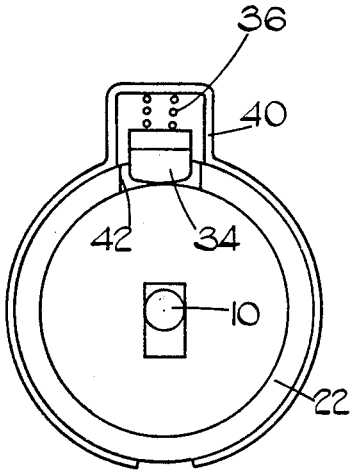
FIG. 7 is a view in the general direction of arrow VII in FIG. 6.

FIGS. 6 and 7 illustrate a further modification which is suitable for carrying small normal currents. In this embodiment, the or each contact block 34 is connected to the conductor 20 via the arcing electrode 22 and the field coil 23 so that the latter is permanently connected in circuit. The or each block 34 is pivotally mounted on a support ring 40 which surrounds an axial extension 41 of the arcing electrode 22, the extension 41 having a cut-out 42 therein in which the contact block 34 is disposed. At the point where the contacts separate, the contact block 34 is substantially flush with the internal surface of the arcing electrode 22. Because the field coil 23 is permanently connected in circuit, the arc is subjected to a magnetic field as soon as it is drawn between the contacts, and therefore commences rotation substantially immediately upon contact separation. This construction for example is suitable for controlling and protecting popular ratings of power transformers in a single switch, contactor or ring main unit configuration.

Figure 8:
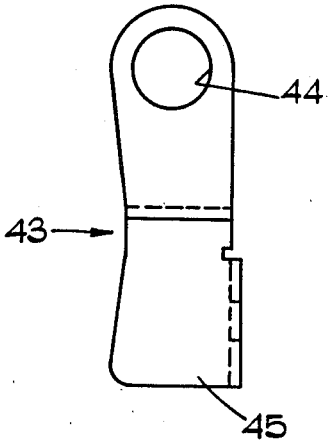
FIGS. 8 and 9 are respectively a side view and a front view of a part used in a modification of the construction shown in FIG. 2.
Figure 9:
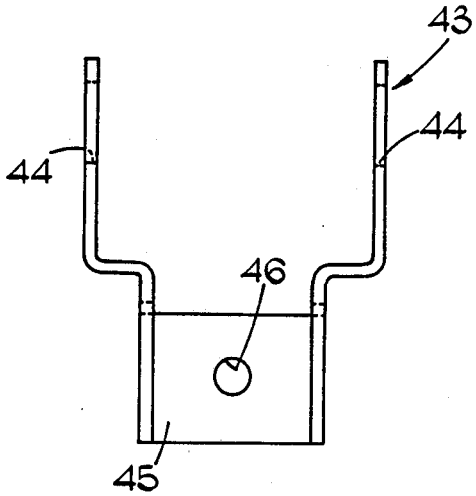

In the embodiment described above in relation to FIG. 2, the extended contact finger 18 is pivotally mounted on the clamping bolt 26 by means of a flat blade portion 28 which hooks over the latter. In an alternative arrangement, the contact portion 27 of the contact finger is instead bolted to a pressed metal stirrup 43, shown in detail in FIGS. 8 and 9, the stirrup having aligned apertures 44 therein through which the clamping bolt 26 is passed. The stirrup 43 includes a generally U-shaped portion 45 which receives the contact portion 27 (not shown in FIGS. 8 and 9), reference numeral 46 denoting a bolt hole through which is passed a bolt (not shown) which secures the contact portion 27 to the stirrup 43. The flexible connection 32 shown in FIG. 2 is sandwiched between the contact portion and the stirrup and is thereby electrically connected thereto, obviating the need for a separate brazing operation. Projecting feet on the stirrup retain the contact portion 27 in the desired position against the action of the biassing spring 31 (FIG. 2).

Figure 10:
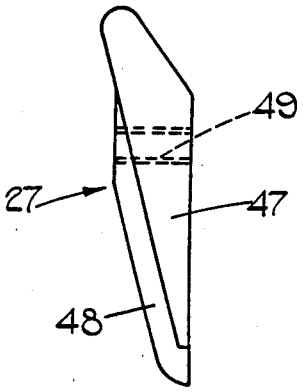
FIG. 10 is a side view of a modified contact finger for use in the construction of FIG. 2.

FIG. 10 illustrates one form of contact portion 27 which can be used with the stirrup 43, the contact portion comprising a main part 47 made of copper and a contact part 48 made of copper tungsten. In operation, only the contact part 48 is engaged by the movable contact arm 10 (FIG. 2). Reference numeral 49 denotes a bolt hole through which the aforementioned securing bolt is passed.

In all of the above-described constructions, when the are has transferred into its rotating mode, electromagnetic loop forces in the plane of the Figures will cause the arc and its products to progress along the arcing electrode 22 away from the contact arm 10. This has the advantage of minimising contamination of the gap G which can thus be made relatively small to assist efficient transfer of the arc root without risk of shorting out the field coil 23 during interruption. Axial progression of the arc along the arcing electrode 22 also gives rise to the following advantages in achieving a high interruption capability for the switchgear:

(1) The arc products are moved away from the contacts and the transfer gap G.

(2) The arc length is allowed to expand, with consequential increased resistance: this aids interruption and minimises the production of over voltages.

(3) The arc root can move over a comparatively large area with a resultant reduction in erosion of the arcing electrode and greater extraction of heat energy from the arc.

In all of the above-described embodiments, the contact arm 10 is mounted on the support 11 by means of a pivot pin, supplemented by a flexible connection or rotating contact, such that it is pivotable about an axis 12 perpendicular to the field coil axis. However, other forms of mounting can be employed as long as the end portion 16 still moves inwardly of the field coil axis as the contacts move towards their fully open position. For example, the pivot pin 12 can be replaced by a flexible connection. In addition, opening and closing of the contacts can be achieved by moving the assembly of the contact fingers 17,18 or contact block 34, arcing electrode 22 and field coil 23 as a whole, rather than by movement of the contact arm 10.

I claim:

1. Electrical switchgear employing an electrically insulating fluid for arc extinction and comprising first and second contacts which are movable between open and closed positions, an arcing electrode electrically connected to said second contact, and a field coil electrically connected in series with said arcing electrode, said field coil having a pole face and an axis, said first contact having an end portion which engages said second contact when said contacts are in said closed position and which, when said contacts are moved towards said open position, moves transversely across said pole face of said field coil and inwardly of said axis thereof, movement of said contacts from said closed position to said open position causing an arc to be drawn therebetween such that said arc has a root on said second contact, and further movement of said contacts towards said open position causing said arc root to be transferred from said second contact to said arcing electrode, whereby a magnetic field is generated by an arcing current flowing through said field coil which causes said arc to rotate and become extinguished, a principal arcing zone being defined by such rotation of said arc, said arc being disposed within said principal arcing zone when said root thereof is transferred from said second contact to said arcing electrode, whereby said arc can rotate immediately under the influence of said magnetic field.

2. Electrical switchgear according to claim 1, wherein said second contact includes a portion which is engageable with said end portion of said first contact, and said arcing electrode has a part which is disposed adjacent to said portion of said second contact, said portion of said second contact being disposed substantially equidistantly from said part of said arcing electrode and from said field coil axis, at least when said contacts disengage.

3. Electrical switchgear according to claim 2, wherein said portion of said second contact is movable between an extended position and a retracted position wherein it is respectively extended and retracted with respect to a remaining part of said second contact, and said first and second contacts disengage from each other when said second contact portion is in said extended position.

4. Electrical switchgear according to claim 3, wherein said portion of said second contact is accommodated within a cutout defined in said arcing electrode.

5. Electrical switchgear according to claim 4, wherein said arcing electrode is tubular and has an internal surface, and said portion of said second contact when in said extended position lies substantially flush with said internal surface of said arcing electrode.

6. Electrical switchgear according to claim 3, further comprising means biassing said portion of said second contact into said extended position.

7. Electrical switchgear according to claim 3, wherein said portion of said second contact is pivotable between said extended and retracted positions.

8. Electrical switchgear according to claim 2, wherein said portion of said second contact is engageable as a sliding contact with a tip of said end portion of said first contact.

9. Electrical switchgear according to claim 2, wherein said portion of said second contact is engageable as a butt contact with a side of said end portion of said first contact.

10. Electrical switchgear according to claim 2, wherein said portion of said second contact is accommodated within a cutout defined in said arcing electrode.

11. Electrical switchgear according to claim 1, wherein said second contact is electrically connected to a connection point between said arcing electrode and said field coil.

12. Electrical switchgear according to claim 1, wherein said first contact is pivotable about a pivot axis which is disposed transversely to said field coil axis.

13. Electrical switchgear according to claim 12, wherein said pivot axis is offset from said field coil axis.

14. Electrical switchgear according to claim 13 wherein said first contact is cranked, and said end portion thereof lies along said field coil axis when said contacts are in said open position.

15. Electrical switchgear according to claim 1, wherein said electrically insulating fluid employed for arc extinction is sulphur hexafluoride gas.

* * * * *

UNITED STATES PATENT AND TRADEMARK OFFICE

CERTIFICATE OF CORRECTION

PATENT NO. : 4,409,446
DATED : October 11, 1983

INVENTOR(S) : John Parry

It is certified that error appears in the above-identified patent and that said Letters Patent are hereby corrected as shown below:

In the heading, insert the priority data:

[30] Foreign Application Priority Data

Feb. 3, 1981 [GB] United Kindgon ..... 8103269

Signed and Sealed this

*Twenty-fourth* Day of *April 1984*

[SEAL]

*Attest:*

GERALD J. MOSSINGHOFF

*Attesting Officer*

*Commissioner of Patents and Trademarks*